US010961022B2

(12) United States Patent
Dreyer et al.

(10) Patent No.: US 10,961,022 B2
(45) Date of Patent: Mar. 30, 2021

(54) THREADED CLOSURE

(71) Applicant: Obrist Closures Switzerland GmbH, Reinach (CH)

(72) Inventors: Lino Dreyer, Rixheim (FR); Sebastien Widmer, Schlierbach (FR); Romain Dampfhoffer, Dittingen (CH)

(73) Assignee: Obrist Closures Switzerland GmbH, Reinach (CH)

( * ) Notice: Subject to any disclaimer, the term of this patent is extended or adjusted under 35 U.S.C. 154(b) by 93 days.

(21) Appl. No.: 16/321,731

(22) PCT Filed: Jul. 31, 2017

(86) PCT No.: PCT/EP2017/069337
§ 371 (c)(1),
(2) Date: Jan. 29, 2019

(87) PCT Pub. No.: WO2018/020053
PCT Pub. Date: Feb. 1, 2018

(65) Prior Publication Data

US 2019/0161247 A1 May 30, 2019

(30) Foreign Application Priority Data

Jul. 29, 2016 (GB) ..... 1613126

(51) Int. Cl.
*B65D 41/04* (2006.01)
*B65D 41/34* (2006.01)

(52) U.S. Cl.
CPC ..... *B65D 41/0471* (2013.01); *B65D 41/0407* (2013.01); *B65D 41/3428* (2013.01)

(58) Field of Classification Search
CPC ..... B65D 41/0471; B65D 41/0407; B65D 41/3428
See application file for complete search history.

(56) References Cited

U.S. PATENT DOCUMENTS 3,295,708 A * 1/1967 Wathen, Jr. ..... B65D 41/0471 215/330
3,979,001 A * 9/1976 Bogert ..... B65D 50/043 215/217

(Continued)

FOREIGN PATENT DOCUMENTS

| | | | |
|---|---|---|---|
| CN | 104053609 | A | 9/2014 |
| EP | 2468654 | A1 | 6/2012 |
| JP | 2009107704 | A | 5/2009 |

OTHER PUBLICATIONS

Feb. 7, 2018—(WO) International Search Report and Written Opinion—App PCT/EP2017/069337.
Sep. 20, 2016—(GB) UK Search Report—App 1613126.0.

*Primary Examiner* — James N Smalley
(74) *Attorney, Agent, or Firm* — Banner & Witcoff, Ltd.

(57) ABSTRACT

A closure is provided and comprises a top plate and a sidewall depending therefrom. The interior of the sidewall has a screw thread formation comprising a plurality of thread segments. The thread segments collectively define an engagement surface for engagement with an external thread formation on an associated container. A notional helical top surface with a constant pitch extends along the formation, and at least some, but not all, of the segments include material offset from the notional helical top surface towards the top plate.

19 Claims, 13 Drawing Sheets

(56) References Cited

U.S. PATENT DOCUMENTS

| | | | | |
|---|---|---|---|---|
| 4,566,603 | A * | 1/1986 | Moore | B65D 41/0428 215/329 |
| 5,713,479 | A * | 2/1998 | Brady | B65D 41/0471 215/330 |
| 9,085,395 | B2 | 7/2015 | Sadiq et al. | |
| 2005/0211659 | A1 * | 9/2005 | Tsutsumi | B65D 41/3457 215/344 |
| 2008/0110850 | A1 * | 5/2008 | Tilton | B65D 41/0471 215/330 |
| 2012/0267372 | A1 | 10/2012 | Sadiq et al. | |
| 2013/0180942 | A1 | 7/2013 | Bardet | |

* cited by examiner

THREADED CLOSURE

CROSS-REFERENCE TO RELATED APPLICATIONS

This application is a U.S. National Stage application under 35 U.S.C. § 371 of International Application PCT/EP2017/069337 (published as WO 2018/020053 A2), filed Jul. 31, 2017 which claims the benefit of priority to U.K. Application serial no. 1613126.0, filed Jul. 29, 2016. Each of these prior applications is hereby incorporated by reference in its entirety.

TECHNICAL FIELD

The present invention relates generally to a closure and particularly, although not exclusively, to a closure for carbonated soft drinks.

BACKGROUND

A known such closure 1 is shown in FIG. 1 and comprises a disc-shape top plate 2 from the periphery of which depends a cylindrical sidewall 3. At the free end of the sidewall 3 a tamper-evident band 4 is connected by frangible bridges 5. An annular inner (olive) seal 6 depends from the top plate 2. An annular outer seal 7 also depends from the top plate 2 radially outwardly of the inner seal and spaced therefrom to define a space which receives a container neck in use. At the top of the sidewall adjacent the top plate an annular pressure block 8 is provided. The interior of the sidewall 3 is provided with a segmented screw thread formation, comprising a plurality of thread segments 9 arranged in a helical pattern. A notional helical top surface line 12 with a constant pitch extends along the formation. For a standard formation all of the line 12 is parallel to a helical line 13 defined by the centreline of the thread segments. In use the closure 1 is screwed onto a container neck; the contents of the container are often carbonated and an effective seal is important to prevent loss of pressure.

In recent times efforts have been made to "lightweight" such closures so as to reduce the amount of material required for production. However, lightweighting of closures can bring with it other problems.

Due to the loss of material in lightweight design closures this gives the problem that the closure is crooked when screwed onto the neck finish. Thereby, vertical displacements appears along the seals are not similar. This deformation is also seen in the 3D model of the tomography results discussed below.

Finite element analysis and tomography have been used by the present inventors to analyse closures of the type shown in FIG. 1, as illustrated in FIGS. 2 to 5.

Figure 1:
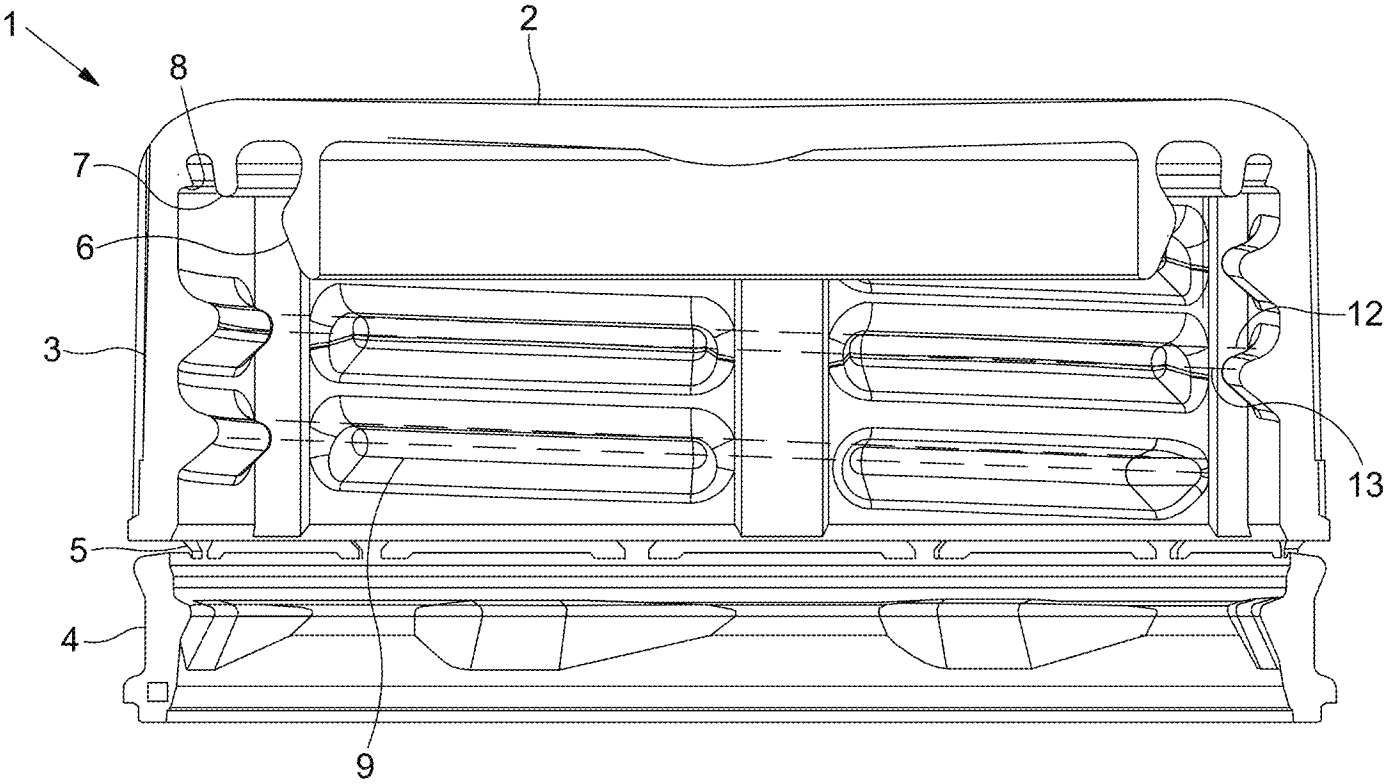
Figure 1 PRIOR ART
Figure 2:
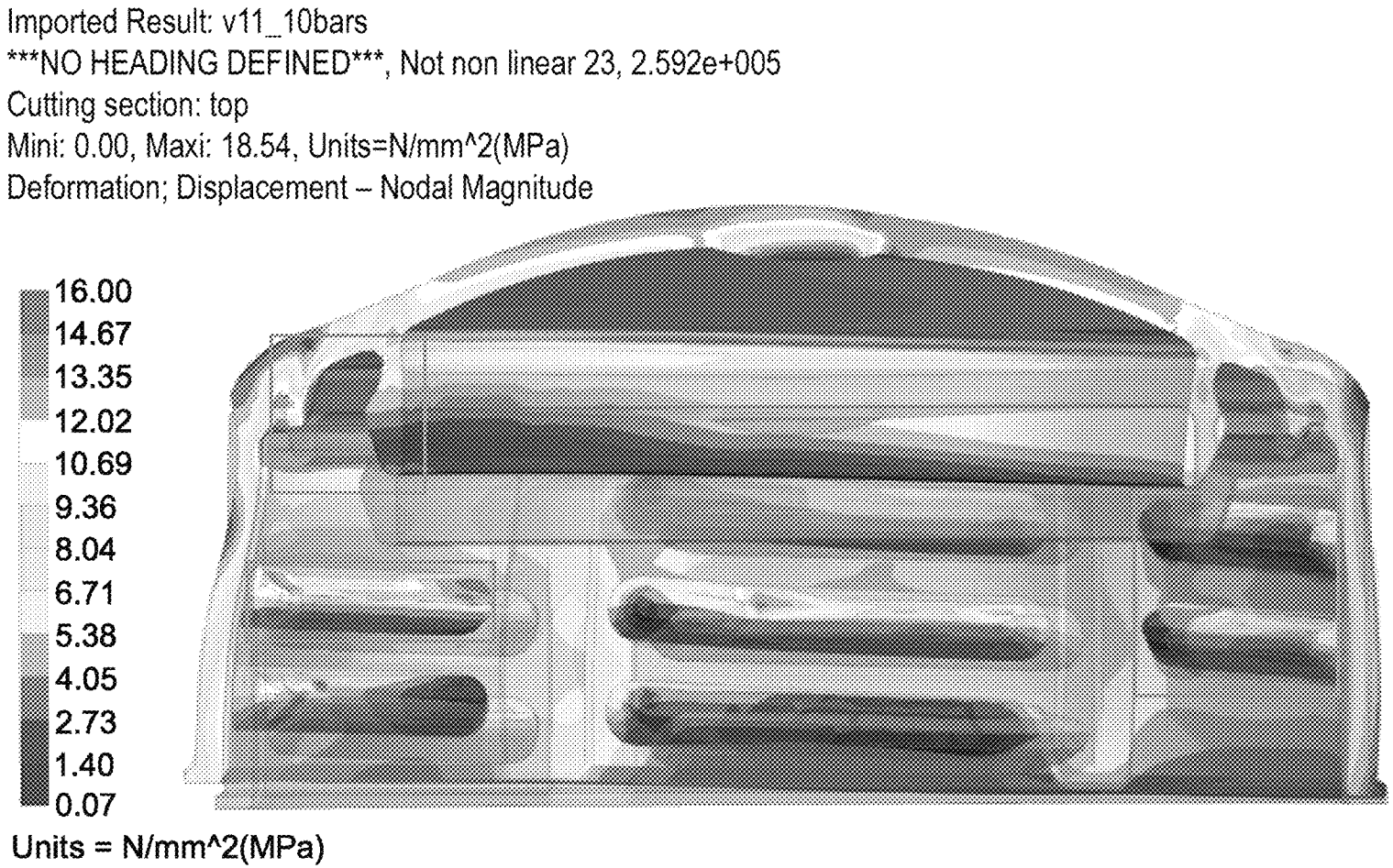
Figure 2 PRIOR ART
FIG. 2 illustrates general observations, which is that there are increased stresses in the uppermost thread segments which are on the "lower" side of the helical thread path, and also in the corresponding circumferential section of the outer seal.
Figure 3:
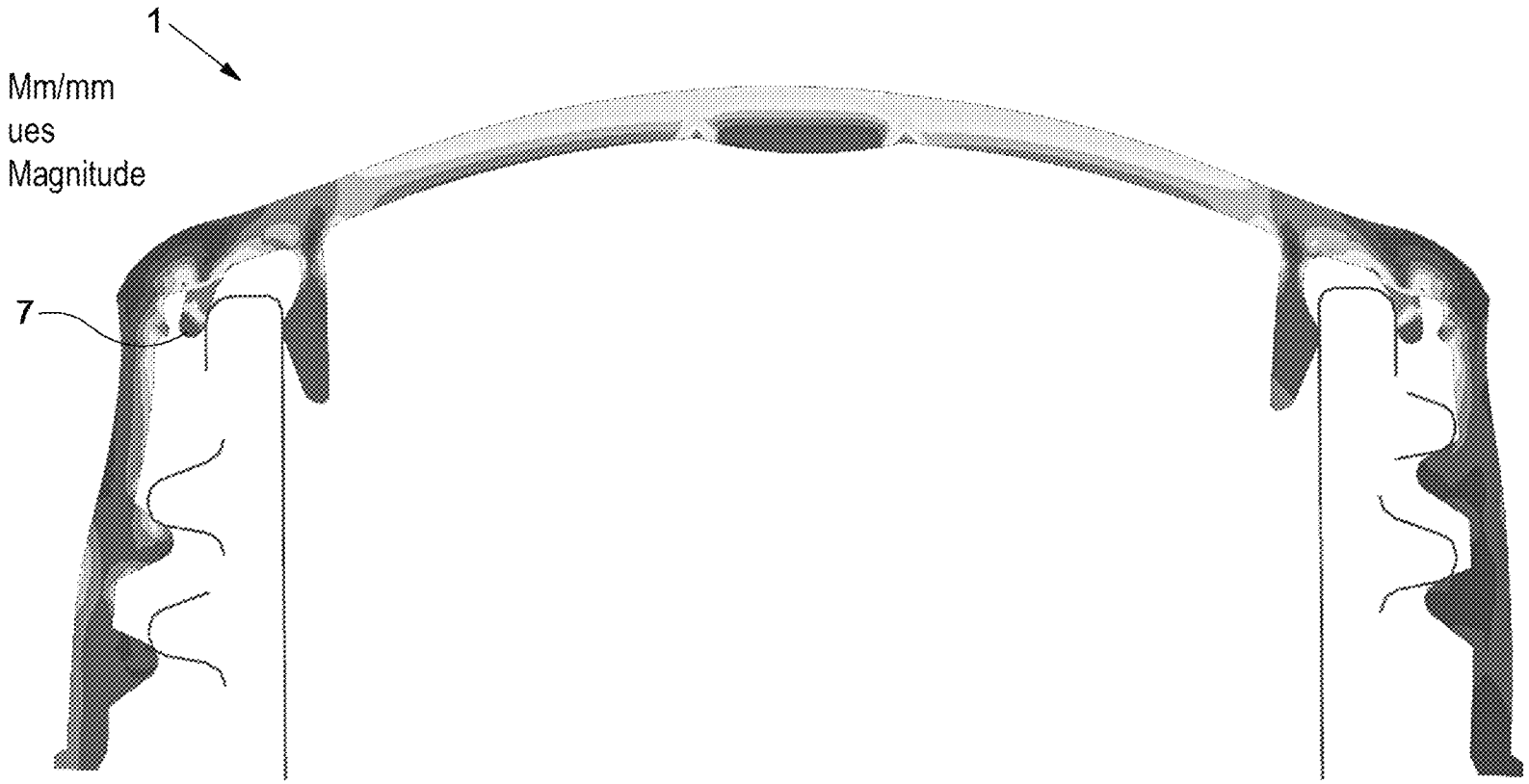
Figure 3 PRIOR ART
Figure 4:
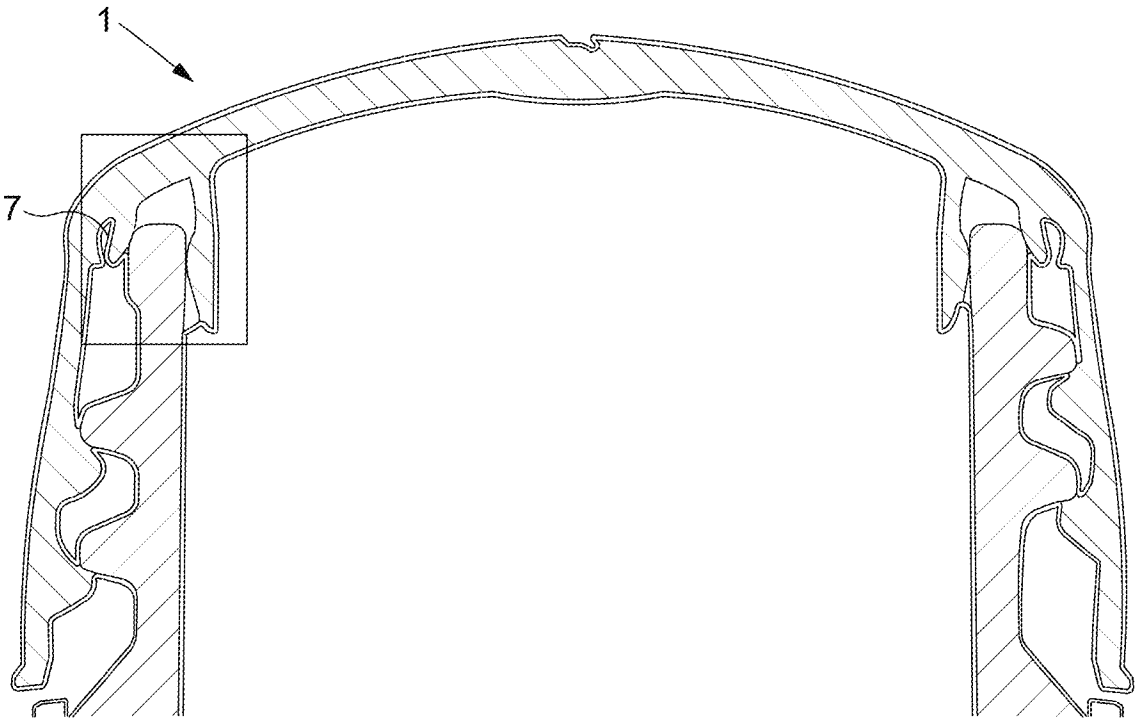
Figure 4 PRIOR ART

Referring also to FIGS. 3 and 4, it has been shown that when under pressure the closure moves more on the side where the helical thread path is low. This results in a "cocked" closure, with more vertical displacement of the outer seal 7. In turn this results in a higher leak risk in this area of the closure.

Figure 5:
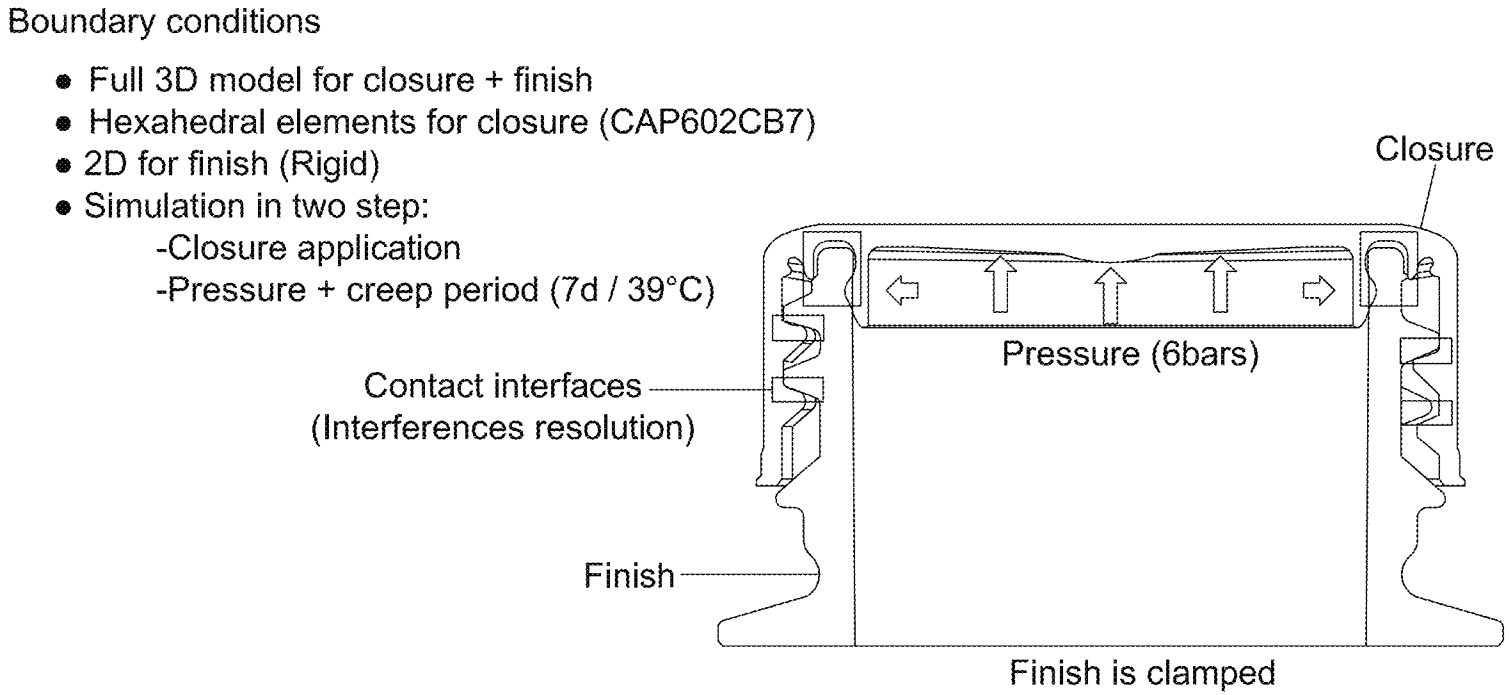
Figure 5 PRIOR ART

The boundary conditions for the tests are shown in FIG. 5.

DETAILED DESCRIPTION

One way of countering this effect is simply to add material all over the closure to increase strength and resist deformation. However, this defeats the object of lightweighting.

The present invention seeks to address the problem of cocking of known (lightweighted) closures.

According to an aspect of the present invention there is provided a closure comprising a top plate and a sidewall depending therefrom, the interior of the sidewall having a screw thread formation, the formation comprising a plurality of thread segments, the thread segments collectively define an engagement surface for engagement with an external thread formation on an associated container, a notional helical top surface with a constant pitch extends along the formation, at least some, but not all, of the segments include material offset from the notional helical top surface towards the top plate.

In some embodiments top surface offset is formed by axial displacement of a segment. Alternatively or additionally top surface offset is formed by additional material along at least part of the top surface of a segment. Alternatively or additionally top surface offset is formed by one or more surface features.

The offset feature may provide additional positive effects such as: venting/degassing, free gap in between the thread contact surface of the closure versus the bottle neck; reduction in friction, reduced thread surface area of the closure versus the bottle neck; weight gain, not full offset surface coverage.

The formation may have centre line with a constant helical pitch.

The notional helical top surface may be based on a notional formation having a standard thread pitch.

The standard thread pitch may be defined by two or more thread segments positioned towards the opposite end of the sidewall to the top plate.

The notional helical top surface pitch may be defined by two or more thread segments positioned towards the opposite end of the sidewall to the top plate In some embodiments only the final three segments (i.e. closest to the top plate) in the formation have offset top surfaces.

In some embodiments the closure has additional material on three segments; all three segments are located towards to top plate.

In some embodiments at least one of the segments has a first axial thickness and at least one of the segments has a second axial thickness which is greater than the first axial thickness and being increased in a direction towards the top plate so as to offset the top contact surface of the formation and compensate vertical displacement of the closure in use.

The or each segment having the second axial thickness may be provided only on one side of the sidewall. In other words the offset has a circumferential restriction.

The or each segment having the second axial thickness may be provided on the side of the sidewall on which the formation terminates at an axial level spaced furthest from the top plate.

The second axial thickness may be formed as an increase in height towards the top plate.

In some embodiments approximately 0.1 mm of material is added to the top contact surface of one or more thread segments.

Closures formed in accordance with aspects and embodiments of the present invention may comprising an inner seal and an outer seal.

Closures may further comprise a pressure formation, such as a pressure block.

A further aspect provides a closure comprising a top plate and a sidewall depending from the periphery thereof, the interior of the sidewall having a screw thread formation, the formation comprising a plurality of separate thread segments, at least one of the segments having a first axial thickness and at least one of the segments having a second axial thickness which is greater than the first axial thickness and being increased in a direction towards the top plate so as to offset the top contact surface of the formation and compensate vertical displacement of the closure in use.

A further aspect provides a carbonated beverage closure comprising a top plate and a sidewall depending from the periphery thereof, the sidewall has an internal screw thread, an inner and outer seal depend from the top plate, the thread comprising a plurality of mutually spaced thread segments arranged in a generally helical pattern, in which the collective top contact surface of the thread segments is non-helical whereby to prevent cocking of the closure when screwed onto a container neck in use.

A further aspect provides a closure comprising a top wall and an annular skirt depending therefrom, the interior of the skirt has a screw thread formation for threaded engagement with an external thread formation on an associated container, the formation comprising a plurality of thread segments, in which the thread segments include two or more different segment profiles, and in which the closure comprises an outer seal for sealing against a container neck, and a pressure formation for pressing the outer seal against the neck.

The thread segments may collectively define an engagement surface for engagement with an external thread formation on an associated container, and a notional helical top surface with a constant pitch may extends along the segments, and some of the segments may include material offset from the notional helical top surface towards the top plate.

The pressure formation may be a pressure block.

The pressure formation may be generally annular.

The pressure formation may be segmented. Alternatively the pressure formation may be continuous.

The pressure formation may be formed on the skirt i.e. projecting radially inwards from the skirt.

In some embodiments the pressure formation is formed at the intersection between the top plate and the skirt.

The skirt may include at least one axially extending vent channel, with the formation interrupted to form the channel.

In some aspects and embodiments the closure is formed in accordance with a principle of a helical offset feature.

According to a further aspect of the present invention there is provided a closure comprising a top plate and a sidewall depending from the periphery thereof, the interior of the sidewall having a screw thread formation, the formation comprising a plurality of separate thread segments, at least one of the segments having a first axial thickness and at least one of the segments having a second axial thickness which is greater than the first axial thickness and being increased in a direction towards the top plate so as to offset the top contact surface of the formation and compensate vertical displacement of the closure in use.

In some embodiments there present invention provides a carbonated soft drink light closure, wherein one, two, three, four, five, six, seven, eight or nine thread segments exhibit a bigger thickness compared to the other thread segments. This can be used to improve and guarantee a better fit of the sealing features at elevated temperatures.

By adding a bit of material to the upper threads this disbalance is compensated.

The or each segment having the second axial thickness may be provided only on one side of the sidewall.

The or each segment having the second axial thickness may be provided on the side of the sidewall, or in that circumferential section of the sidewall, on which the helical screw thread formation path terminates at an axial level spaced furthest from the top plate.

The second axial thickness may be formed as an increase in height towards the top plate.

In some embodiments 0.01 to 0.3 mm, preferably approximately 0.1 mm, of material is added to the top contact surface of one or more thread segments.

The closure may comprise an inner seal and an outer seal and may further comprise a pressure block.

In some embodiments the present invention is based on a principle of deliberately off-setting the top contact surface of the thread versus the standard thread pitch in order to reduce the degree of cocking observed on a closure exposed to elevated temperatures and high pressure.

On some containers there is a portion of the neck finish where only one thread is available for the closure to engage. This increases the contact pressure in this closure thread segment and through material relaxation allows the closure to cock. By off-setting the closure in the initial phase the amount of coking can be reduced to provide a better fit of sealing features at elevated temperature.

Some aspects and embodiments of the present invention relate to a beverage screw cap.

The present invention also provides a lightweight carbonated soft drinks closure comprising a top plate and a sidewall depending from the periphery thereof, the sidewall has an internal screw thread, the thread comprising a plurality of mutually spaced thread segments arranged in a helical pattern, in which the top contact surface of the thread is offset whereby to prevent cocking of the closure when screwed onto a container neck in use.

The present invention also provides a closure as described herein in combination with a container.

Different aspects and embodiments of the invention may be used separately or together.

Further particular and preferred aspects of the present invention are set out in the accompanying independent and dependent claims. Features of the dependent claims may be combined with the features of the independent claims as appropriate, and in combinations other than those explicitly set out in the claims.

The present invention will now be more particularly described, by way of example, with reference to the accompanying drawings.

The example embodiments are described in sufficient detail to enable those of ordinary skill in the art to embody and implement the systems and processes herein described. It is important to understand that embodiments can be provided in many alternative forms and should not be construed as limited to the examples set forth herein.

Accordingly, while embodiments can be modified in various ways and take on various alternative forms, specific embodiments thereof are shown in the drawings and described in detail below as examples. There is no intent to limit to the particular forms disclosed. On the contrary, all modifications, equivalents, and alternatives falling within the scope of the appended claims should be included. Elements of the example embodiments are consistently denoted by the same reference numerals throughout the drawings and detailed description where appropriate.

Unless otherwise defined, all terms (including technical and scientific terms) used herein are to be interpreted as is customary in the art. It will be further understood that terms in common usage should also be interpreted as is customary in the relevant art and not in an idealised or overly formal sense unless expressly so defined herein.

In the following description, all orientational terms, such as upper, lower, radially and axially, are used in relation to the drawings and should not be interpreted as limiting on the invention.

Figure 6:
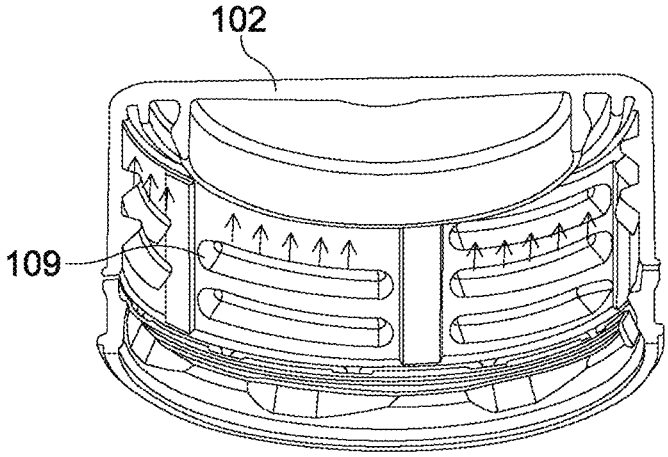

FIG. 6 illustrates the general principle of one embodiment of the present invention in which thread segments 109 in a restricted circumferential section (for example around about half of the circumference of the sidewall) are increased in height towards the top plate 102.

Figure 7:
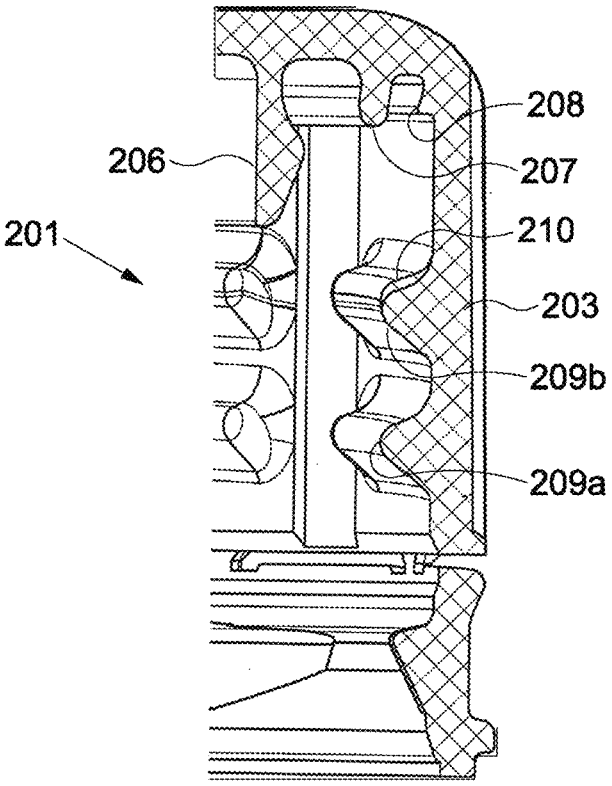

FIG. 7 shows part of a closure 201 formed in accordance with the present invention. The sidewall 203 includes some "standard" thread segments 209*a* and some increased height segments 209*b* with additional material 210. Adding thickness only on some thread segments provides compensation for displacement. In this embodiment the additional material increases the top contact surface by approximately 0.1 mm. In this way, this part of the thread path is offset over the standard thread pitch.

Figure 8:
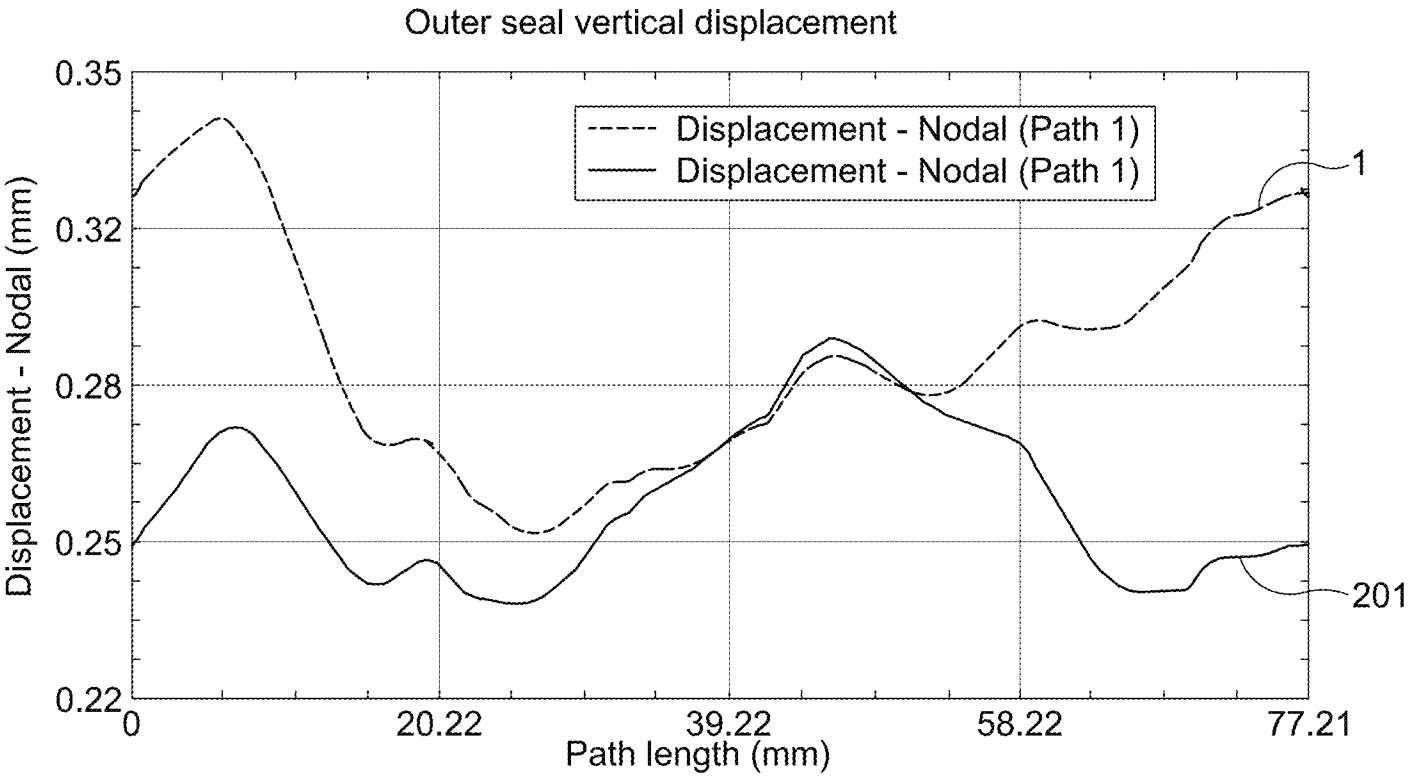

FIG. 8 shows a graph illustrating the axial displacement of the outer seal of the closure 1 compared with the closure 207 when subjected to elevated temperature and pressure. It can be seen outer seal displacement in the closure 207 is greatly reduced, leading to a reduced risk of leakage in use.

Figure 10:
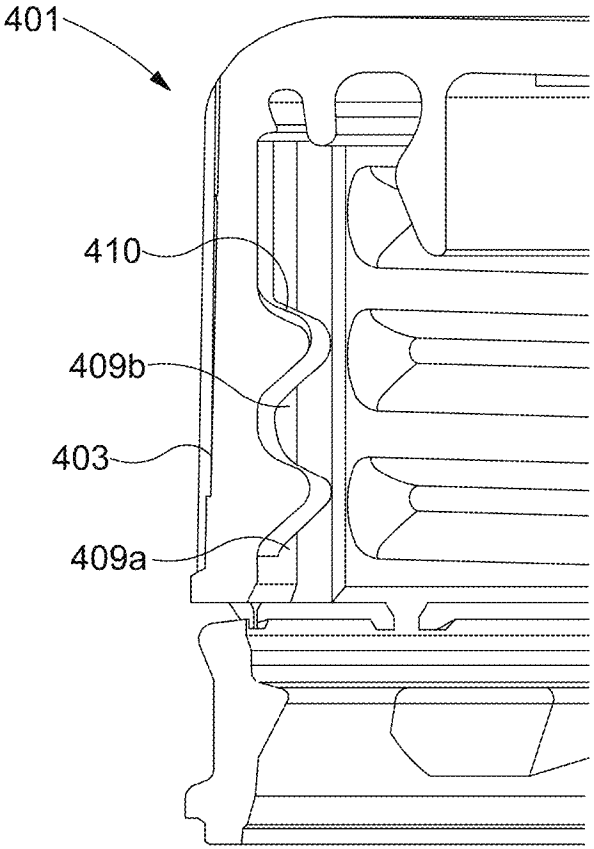
Figure 9:
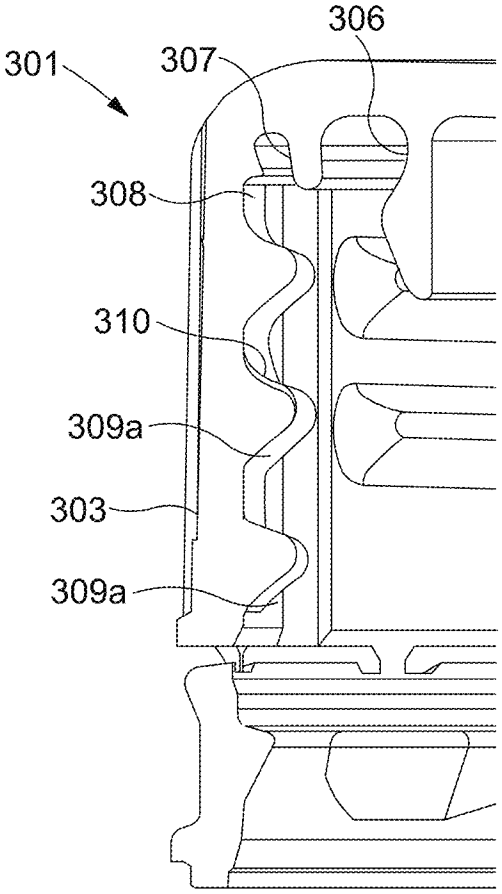

FIGS. 9 and 10 show two further embodiments in which closure thread segments 309*b*, 409*b* include additional material 310, 410.

Figure 11:
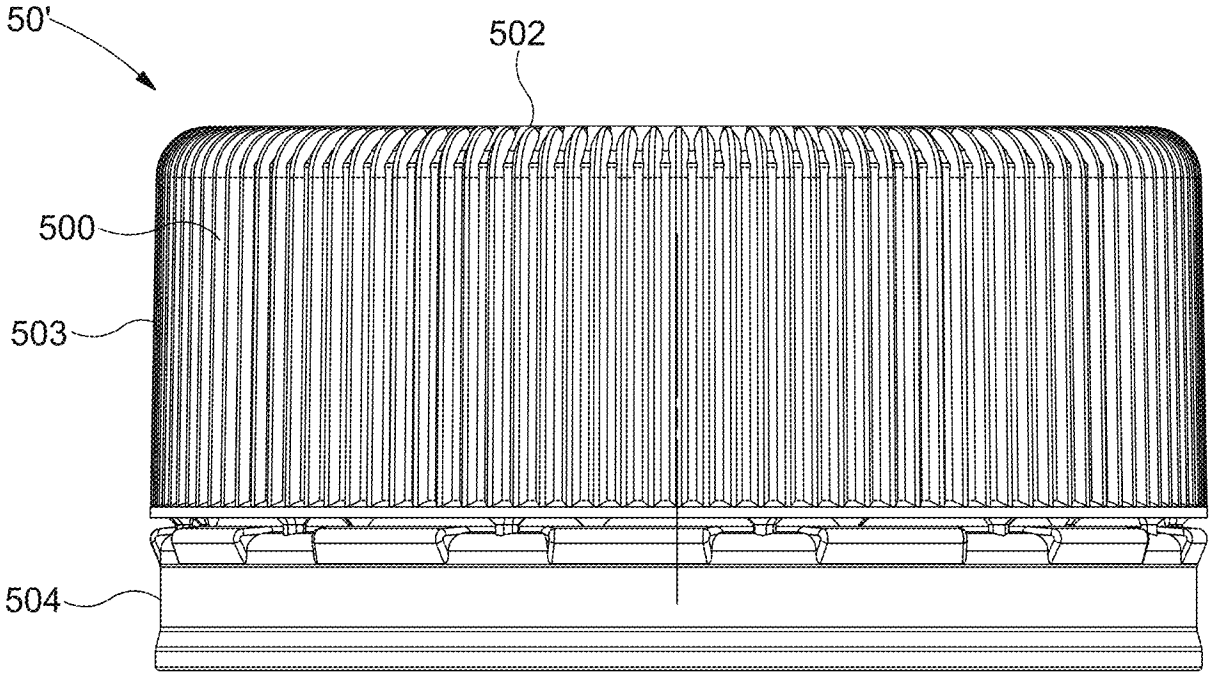

FIG. 11 shows an exterior view of a closure 501 formed in accordance with a further embodiment and having a top wall 502 and a side skirt 503. The skirt 503 has a plurality of external ribs 500.

FIGS. 12A to 12D show sections of closures 601, 701, 801, 901 formed in accordance with the present invention and illustrating different options for providing a thread formation having a top contact surface which is partially non-helical.

Figure 12:
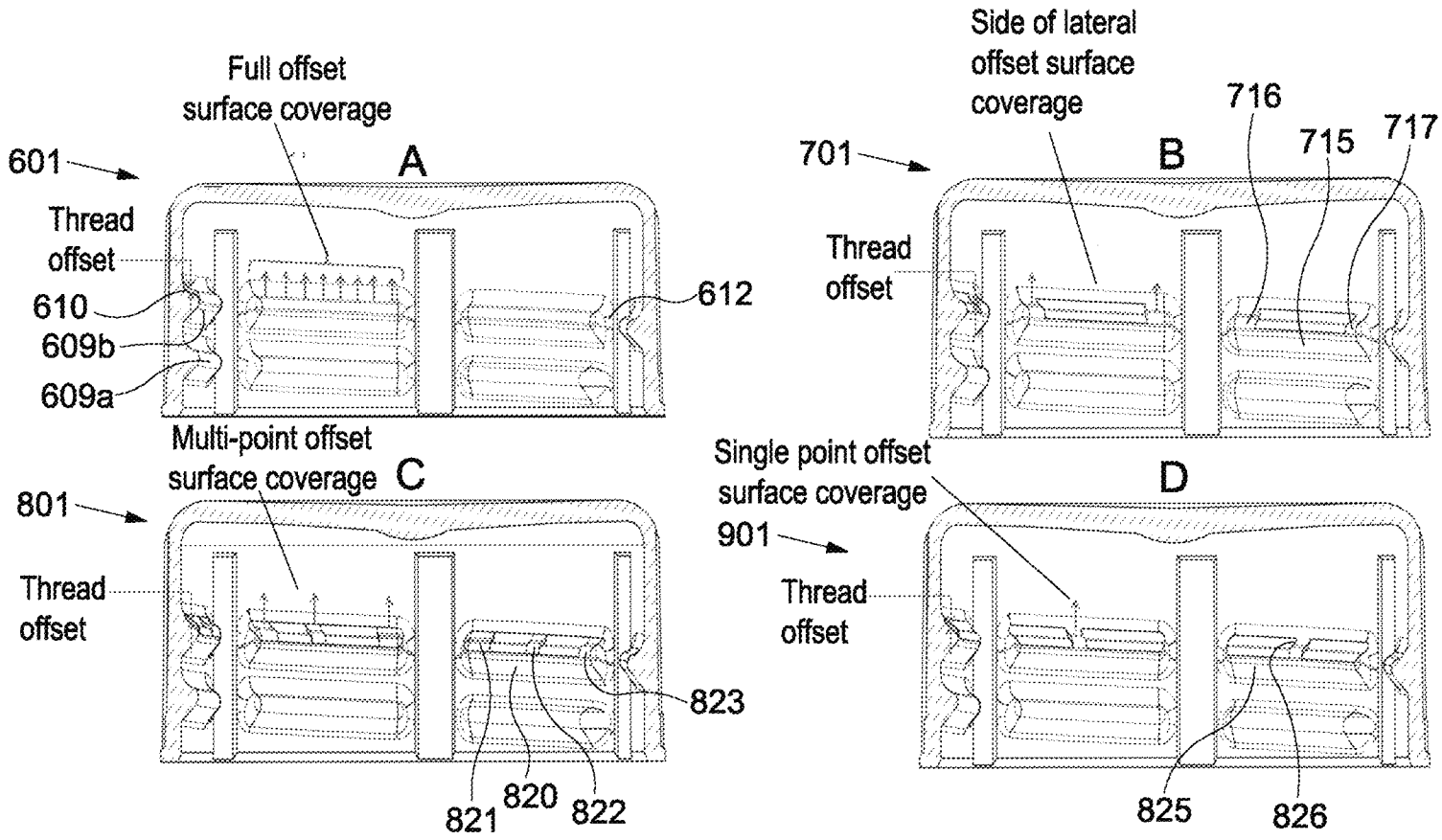

In the closure 601 FIG. 12A additional material 610 is added to some of the segments 609*b*. This means that the top surface of segments 609*a* without additional material align with the notional helical line 612, whereas the top surface of segments 609*b* with the additional material project above the line 612.

The same effect as with adding material onto a thread segment to provide material extending beyond the notional helical top surface line can also be achieved via some additional bars, ramps, dots etc: see FIGS. 12B, C and D.

In FIG. 12B the closure 701 has some thread segments 715 with lateral thread projections 716, 717

In FIG. 12C the closure 801 has some segments 820 with multiple point axially extending projections 821, 822, 823.

In FIG. 12D the closure 901 has some thread segments 825 with a single point extension 826.

Alternatively or additionally, the additional material could be in the form of a wave etc. (not shown). Furthermore, individual threads (in some embodiments only the three top threads are of highest relevance) can be shifted upwards towards the top plate; this would result in thread segments with top contact surfaces above the notional helical line, and also a non-helical centreline e.g. some segments (principally at or towards the end of the thread formation (closest to the top plate) would be above a notional centreline define by a majority of the thread segments (particularly those at the start of the thread formation).

Having the new offset feature (bars etc.) can also have the beneficial effects of: 1) providing secondary venting (additionally venting channels); 2) minimize friction since the thread does not have full contact with the neck; 3) further weight saving, since the amount used for the bumps/bars is less than putting additional material onto the whole thread segment.

Figure 13:
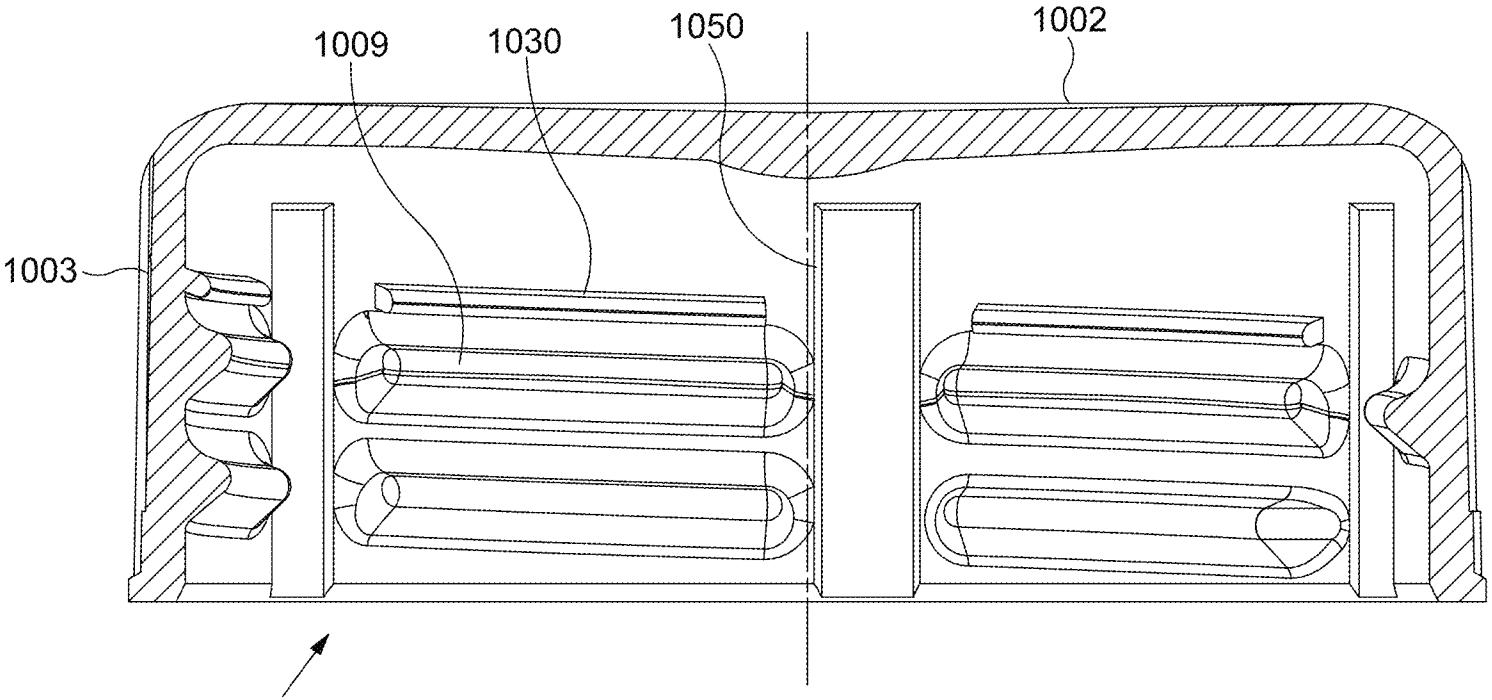
Figure 14:
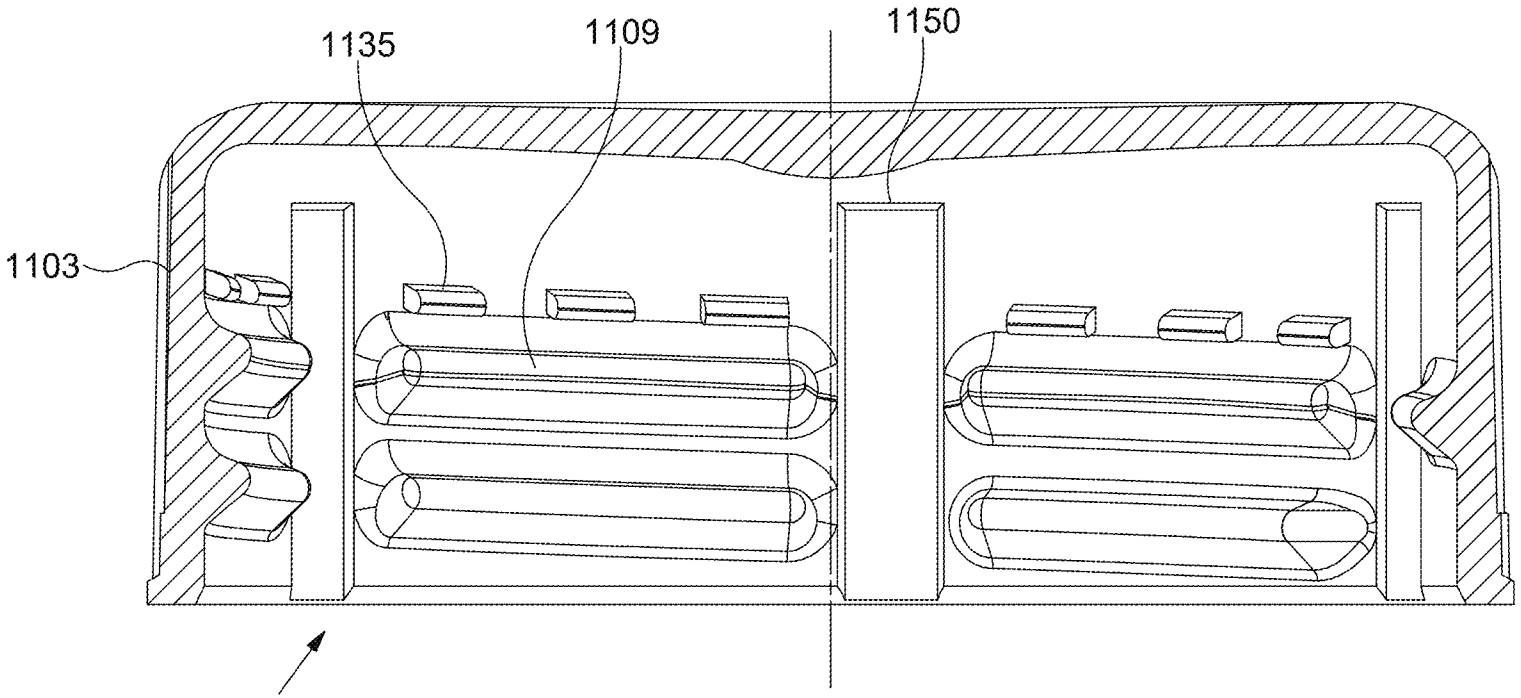
Figure 15:
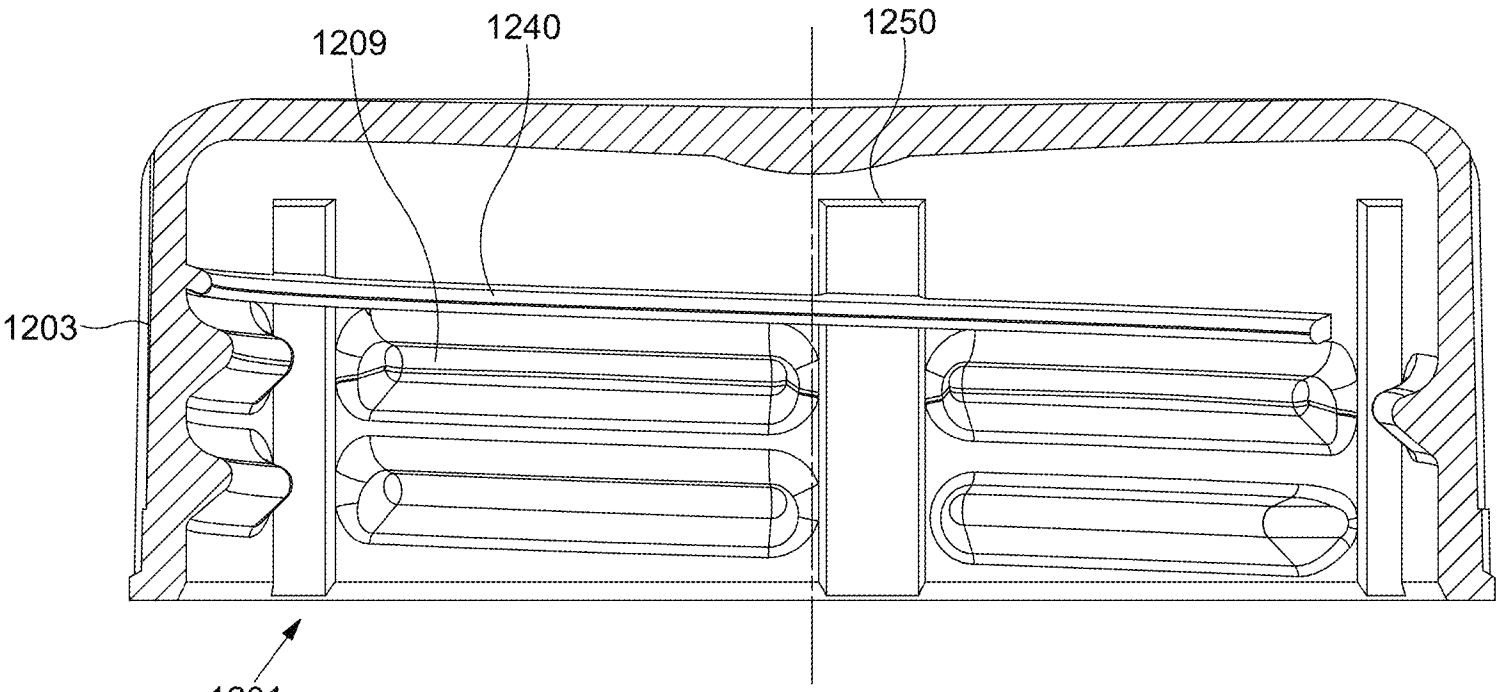

FIGS. 13 to 15 relate to the incorporation of a pressure block feature.

The pressure block functions to centre the closure onto the neck, thereby vertical movement is further reduced.

In FIG. 13 the closure 1001 has a pressure block comprising a plurality of arcuate block segments 1030 extending radially inwards from the sidewall 1003; each of the segments has a circumferential extent corresponding to an underlying thread segment 1009. The thread segments are also separated by axial vent channels 1050.

In FIG. 14 the closure 1101 has a pressure block comprising block segments 1135. In this embodiments there are three block segments provided above each thread segment 1109.

In FIG. 15 the closure 1201 has a pressure block comprising a complete annulus 1240.

Although illustrative embodiments of the invention have been disclosed in detail herein, with reference to the accompanying drawings, it is understood that the invention is not limited to the precise embodiments shown and that various changes and modifications can be effected therein by one skilled in the art without departing from the scope of the invention as defined by the appended claims and their equivalents.

The invention claimed is:

1. A closure comprising a top plate and a sidewall depending therefrom, the interior of the sidewall having a screw thread formation, the formation comprising a plurality of thread segments, the thread segments collectively define an engagement surface for engagement with an external thread formation on an associated container, a notional helical top contact surface with a constant pitch extends along the formation, at least some, but not all, of the segments include material offset from the notional helical top contact surface towards the top plate, and wherein at least one of the segments has a first axial thickness and at least one of the segments has a second axial thickness, which is greater than the first axial thickness and being increased in a directed towards the top plate so as to offset the top contact surface of the formation and compensate vertical displacement of the closure in use, characterized in that each segment having the second axial thickness is provided only on one side of the sidewall.

2. A closure as claimed in claim 1, in which top contact surface offset is formed by axial displacement of a segment.

3. A closure as claimed in claim 1, in which top contact surface offset is formed by additional material along at least part of the top surface of a segment.

4. A closure as claimed in claim 1, in which the top contact surface offset is formed by one or more surface features.

5. A closure as claimed in claim 1, in which the second axial thickness is formed by full offset surface coverage of each segment having the second axial thickness.

6. A closure as claimed in claim 1, in which second axial thickness is formed by lateral thread projections on each segment having the second axial thickness.

7. A closure as claimed in claim 1, in which the second axial thickness is formed by multiple point axially extending projections on each segment having the second axial thickness.

8. A closure as claimed in claim 1, in which the second axial thickness is formed by a single point extension on each segment having the second axial thickness.

9. A closure as claimed in claim 1, in which only the final three segments in the formation, closet to the top plate, have offset top surfaces.

10. A closure as claimed in claim 1, in which thread segments are separated by axial vent channels.

11. A closure as claimed in claim 1, comprising an inner seal and an outer seal.

12. A closure as claimed in claim 1, further comprising a pressure formation.

13. A closure as claimed in claim 12 wherein the pressure formation comprises a complete annulus or a plurality of formation segments.

14. A closure as claimed in claim 12 wherein the pressure formation comprises a plurality of arcuate formation segments each of the segments having a circumferential extent corresponding to an underlying thread segment.

15. A closure as claimed in claim 12 wherein the pressure formation is formed at the intersection between the top plate and the sidewall.

16. A closure as claimed in claim 1, in which additional material is added to some of the segments such that the top surface of segments without additional material align with the notational helical top surface, whereas the top surface of segments with the additional material project above the notional helical top surface.

17. A closure as claimed in claim 1, in which each thread segment having the second axial thickness extend around about half of the circumference of the sidewall.

18. A closure comprising a top plate and a sidewall depending therefrom, the interior of the sidewall having a screw thread formation, the formation comprising a plurality of separate thread segments, the thread segments collectively define an engagement surface for engagement with an external thread formation on an associated container, a notional helical top surface with a constant pitch extends along the formation, at least some, but not all, of the segments include material offset from the notional helical top surface towards the top plate, in which at least one of the segments having a first axial thickness and at least one of the segments having a second axial thickness which is greater than the first axial thickness and being increased in a direction towards the top plate so as to offset the top contact surface of the formation and compensate vertical displacement of the closure in use, and in which each segment having the second axial thickness is provided only on one side of the sidewall.

19. A closure as claimed in claim 18 wherein the closure is in combination with a container.

* * * * *